US009677568B2

(12) United States Patent
Vetter et al.

(10) Patent No.: US 9,677,568 B2
(45) Date of Patent: Jun. 13, 2017

(54) TURBOCHARGER HOUSING HAVING A VALVE DEVICE, AND METHOD FOR MANUFACTURING A TURBOCHARGER HOUSING OF SAID TYPE

(75) Inventors: Robert Vetter, Worms (DE); Alexandre Pfister, Neuchatel (CH)

(73) Assignee: Continental Automotive GmbH, Hannover (DE)

( * ) Notice: Subject to any disclaimer, the term of this patent is extended or adjusted under 35 U.S.C. 154(b) by 1226 days.

(21) Appl. No.: 13/638,804

(22) PCT Filed: Mar. 18, 2011

(86) PCT No.: PCT/EP2011/054146

§ 371 (c)(1),
(2), (4) Date: Dec. 19, 2012

(87) PCT Pub. No.: WO2011/120825

PCT Pub. Date: Oct. 6, 2011

(65) Prior Publication Data

US 2013/0136578 A1 May 30, 2013

(30) Foreign Application Priority Data

Mar. 29, 2010 (DE) ..... 10 2010 013 264

(51) Int. Cl.
*F04D 27/00* (2006.01)
*F01D 17/10* (2006.01)
(Continued)

(52) U.S. Cl.
CPC ..... *F04D 27/009* (2013.01); *B22D 17/00* (2013.01); *B22D 17/24* (2013.01); *F01D 9/026* (2013.01);
(Continued)

(58) Field of Classification Search
CPC ..... F04D 27/009; F04D 27/0207; F04D 27/0215; B22D 17/002; F01D 17/105;
(Continued)

(56) References Cited

U.S. PATENT DOCUMENTS 4,181,466 A * 1/1980 Owen ..... F04D 25/04 29/888.024
5,137,003 A 8/1992 Kyoya et al.
(Continued)

FOREIGN PATENT DOCUMENTS

BE 488 664 A 4/1949
CN 101529062 A 9/2009
(Continued)

OTHER PUBLICATIONS

Fan Jianbei et al., "Diecasting Mold and Other Molds", China Machine Press, Jan. 31, 2005, pp. 1-7—Statement of Relevance.
(Continued)

*Primary Examiner* — Dwayne J White
*Assistant Examiner* — Su Htay
(74) *Attorney, Agent, or Firm* — Laurence A. Greenberg; Werner H. Stemer; Ralph E. Locher

(57) ABSTRACT

A turbocharger housing has a valve device. The valve device is formed with at least one first duct section and a second duct section. The two duct sections are arranged with their longitudinal axes parallel to one another and they are formed without any undercuts.

19 Claims, 5 Drawing Sheets

(51) Int. Cl.

| | |
|---|---|
| ***B22D 17/24*** | (2006.01) |
| ***F01D 9/02*** | (2006.01) |
| ***F04D 27/02*** | (2006.01) |
| ***F04D 29/42*** | (2006.01) |
| ***B22D 17/00*** | (2006.01) |

(52) U.S. Cl.
CPC ..... *F01D 17/105* (2013.01); *F04D 27/0215* (2013.01); *F04D 29/4206* (2013.01); *F05D 2220/40* (2013.01); *F05D 2250/312* (2013.01)

(58) Field of Classification Search
CPC . F05D 2220/40; F05D 2250/312; F02B 37/16
See application file for complete search history.

(56) References Cited

U.S. PATENT DOCUMENTS

| | | | | |
|---|---|---|---|---|
| 5,173,021 | A | 12/1992 | Grainger et al. | |
| 8,161,745 | B2 | 4/2012 | Dörle et al. | |
| 8,387,383 | B2 | 3/2013 | Thiery et al. | |
| 8,973,891 | B2 | 3/2015 | Maeda et al. | |
| 2005/0103012 | A1 | 5/2005 | Bayer et al. | |
| 2005/0144946 | A1* | 7/2005 | Claus | B22C 9/103 60/605.1 |
| 2007/0057213 | A1* | 3/2007 | Noelle | F02B 37/16 251/61.3 |
| 2010/0047054 | A1* | 2/2010 | Dorle | F01D 9/026 415/11 |
| 2012/0148386 | A1* | 6/2012 | Lombard | F01D 17/105 415/145 |

FOREIGN PATENT DOCUMENTS

| | | | |
|---|---|---|---|
| DE | 69005357 | T2 | 5/1994 |
| DE | 10020041 | C2 | 5/2003 |
| DE | 202009014443 | U1 | 2/2010 |
| DE | 10 2009 012 732 | A1 | 9/2010 |
| DE | 112010005398 | B4 | 6/2015 |
| EP | 0122328 | A1 | 10/1984 |
| EP | 0 468 676 | A1 | 1/1992 |
| WO | 2007031752 | A1 | 3/2007 |
| WO | 2007048828 | A1 | 5/2007 |
| WO | 2008/055588 | A1 | 5/2008 |

OTHER PUBLICATIONS

Fritz, A. et al., Fertigungstechnik; 2. new arranged and added edition, VDI Verlag, 1990, pp. 10 and 65-68—Statement of Relevance.

Niemann G: "Maschinenelemente", vol. I, 2nd Edition, Springer-Verlag Berlin Heidelberg New York, 1981, pp. 22 and 23, ISBN 3-540-06809-0—Statement of Relevance.

* cited by examiner

TURBOCHARGER HOUSING HAVING A VALVE DEVICE, AND METHOD FOR MANUFACTURING A TURBOCHARGER HOUSING OF SAID TYPE

BACKGROUND OF THE INVENTION

Field of the Invention

The invention relates to a turbocharger housing with at least one valve device, for example a turbocharger housing with an overrun air recirculation valve. Furthermore, the invention relates to a method for manufacturing such a turbocharger housing.

Turbochargers normally have a turbine which is arranged in an exhaust gas flow and is connected via a shaft to a compressor in the intake tract. A turbine wheel and an impeller are generally arranged on the shaft in this case. Via the exhaust gas flow of an associated engine, the turbine wheel of the turbine is driven. The turbine wheel in turn drives the impeller of the compressor in the process. As a result of this, the compressor can increase the pressure in the intake tract of the engine so that during the intake cycle a larger amount of air makes its way into the cylinder. This has the result that more oxygen is made available and a correspondingly larger amount of fuel can be combusted.

In order to now prevent or to reduce as far as possible the rotational speed of the turbocharger dropping off, for example during an engine overrun mode, modern turbochargers have overrun air recirculation valves. These overrun air recirculation valves are seated on the turbocharger in the compressor housing, which is produced from aluminum. The function of the overrun air recirculation valve is realized via passages between an inlet side and an outlet side and a valve seat, which represents the sealing plane. These overflow passages and also the valve seat customarily have complex geometries.

A compressor housing of a turbocharger, which features an overrun air recirculation valve or bypass valve, is known from WO2008/055588.

The compressor housing in this case has a valve flange on which the bypass valve can be fastened. To this end, the valve flange has a flange face in which an inlet opening is arranged, adjoining which inlet opening is a connecting passage to the compressor inlet. Furthermore, the valve flange has a valve seat for the closing element of the bypass valve. A passage axis of the connecting passage is arranged in this case at an angle $\beta$ to the valve seat. Furthermore, the flange face is arranged at an angle $\alpha$ to a reference surface which is provided perpendicularly to the turbocharger axis and axially delimits the spirals of the compressor housing towards the bearing housing side. The compressor housing has the disadvantage in this case that it has a complex shape and it is only with difficulty that the predetermined angles $\alpha$, $\beta$ are to be realized with a sufficient degree of accuracy.

BRIEF SUMMARY OF THE INVENTION

Therefore, it is the object of the present invention to provide a turbocharger housing, which is to be produced in a simplified manner, with a valve device, and to provide a method for producing such a turbocharger housing.

This object is achieved by means of a turbocharger housing, with a valve device, with the features as claimed, and by means of a method for producing a turbocharger housing, with a valve device, as claimed.

Accordingly, a turbocharger housing with a valve device is provided according to the invention, wherein the valve device has at least a first passage section and a second passage section, wherein the two passage sections are arranged parallel to one another by their longitudinal axes and are formed free of an undercut.

The turbocharger housing in this case has the advantage that it can be formed with a valve device by pressure diecasting by means of a simply designed and inexpensive slide element.

The mold slide element can be simply designed since the valve device has two passage sections which are parallel to one another and are formed free of an undercut. As a result, the slide element can also be very simply inserted into the pressure diecasting mould during the pressure diecasting process and can easily be removed again from this and from the turbocharger housing.

Advantageous embodiments and developments of the invention are to be gathered from the dependent claims and also from the description with reference to the drawings.

The invention is explained in more detail in the following text based on the exemplary embodiments which are represented in the schematic figures of the drawings. In the drawings:

DESCRIPTION OF THE INVENTION

In all the figures, the same or functionally the same elements and devices have been provided with the same designations, unless otherwise indicated.

Figure 1:
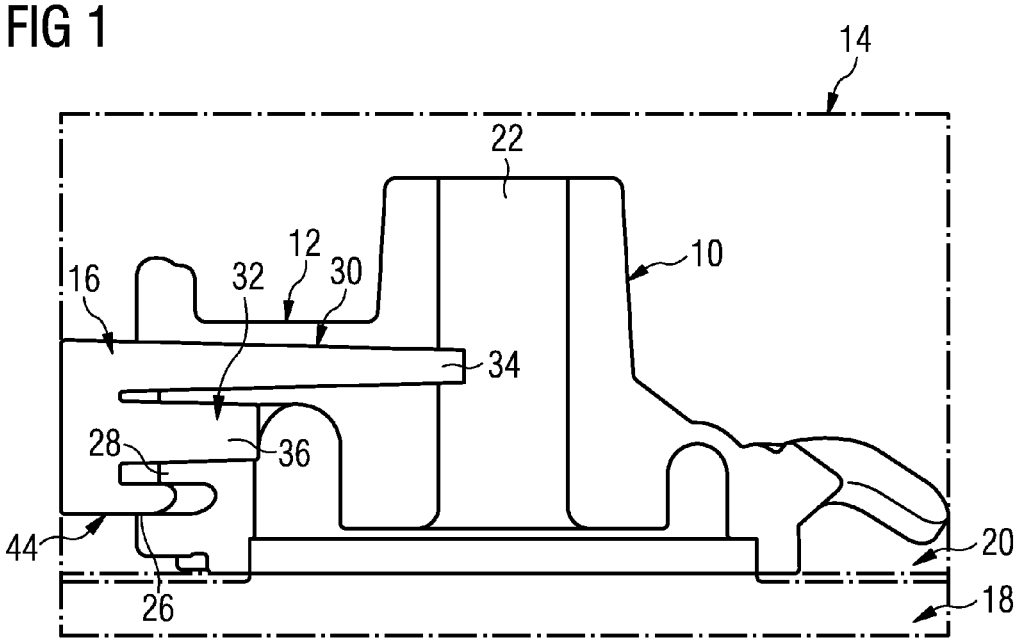
FIG. 1 shows a sectional view of a turbocharger housing, with a valve device, according to the invention, wherein for forming the valve device a mold slide element is partially inserted into the turbocharger housing.

Shown in FIG. 1 is a sectional view of a finished turbocharger housing 10, with at least one valve device 12, according to the invention. The turbocharger housing 10 is produced in this case in a pressure diecasting process, for example as an aluminum pressure diecasting or from another material or material combination which is suitable for the pressure diecasting process. To this end, provision is made for a pressure diecasting mold 14 in which a mold slide element 16 is arranged, as is shown by way of example in FIG. 1, in order to form a valve device 12 in the turbocharger housing 10. In this case, the pressure diecasting mold can be formed in a manner in which it is split, for example, into two mold halves 18, 20 in a horizontal, or for most part horizontal, plane, as is shown in FIG. 1 by a dashed line. The pressure diecasting mold and its two mold halves are only indicated in FIG. 1 and represented in a greatly simplified and purely schematic manner. One mold half 18 in this case can form, for example, the inner passage 22 and the spiral housing 24, and the other mold half 20 can form the external contour of the turbocharger housing 10, as is indicated in FIG. 1. In this case, the pressure diecasting mold 14 can be designed in such a way that the mold slide element 16 is accommodated in one mold half of the pressure diecasting mold or in both mold halves 18, 20 of the pressure diecasting mold.

In the finished turbocharger housing 10 in FIG. 1, the mold slide element 16, with which the valve device 12, in this case an overrun air recirculation valve, for example, has been formed in the turbocharger housing 10, is shown partially inserted.

The turbocharger housing 10 according to the invention is formed as a separate compressor housing in the present example, and can be fastened, for example, on a bearing housing of the turbocharger. Similarly, a compressor housing of a turbocharger housing, which is formed in one piece with a bearing housing, for example, can also be formed according to the invention with a valve device 12 (not shown).

As is shown in the example in FIG. 1, at least one valve device 12 is formed in the turbocharger housing 10. In this case, the mold slide element 16 is formed in such a way as to form or to mold the valve chamber 26, preferably the entire valve chamber, the valve seat 28 and a passage, or a plurality of passages 30, 32, of the valve device 12 in the turbocharger housing 10.

In the example shown in FIG. 1 and in the subsequent FIGS. 2 to 12, an overrun air recirculation valve, for example, is provided as the valve device 12. The invention is not limited to an overrun air recirculation valve, however.

For forming the overrun air recirculation valve 12 as the valve device 12 the corresponding mold slide element 16 has for example two passage projections or passage section projections 34, 36, i.e. a first passage section projection 34 which is arranged for example on the outside and a second passage section projection 36 which is arranged for example on the inside. The first, outer passage section projection 34 in this case forms the outflow passage or outlet passage 38, which for example is connected to an inlet region of the intake side or of the intake duct of the compressor. The second, inner passage section projection 36 in turn forms for example the inflow passage or inlet passage 40 which is connected to the inlet region of the pressure side of the compressor.

The two passage section projections 34, 36 of the mold slide element 16 are arranged in relation to one another in this case in such a way that the mold slide element 16, following a pressure diecasting process for forming the turbocharger housing 10, can be easily withdrawn or extracted again from the pressure diecasting mold 14 and from the turbocharger housing 10. For this purpose, the mold slide element 16 is formed without undercuts or does not have an undercut. The two passage section projections 34, 36 of the mold slide element 16 are arranged parallel to one another in the longitudinal direction, wherein the two passage section projections 34, 36, can be provided in this case parallel and offset to one another, or parallel, by their longitudinal axes 42, and with their longitudinal axes 42 lying in a vertical or perpendicular plane or coaxially to one another, as is subsequently shown in FIGS. 3 and 4.

Furthermore, the mold slide element 16 has a valve chamber section 44, wherein the valve chamber section 44 is designed in such a way that it forms the complete valve chamber 26, or for the most part the complete valve chamber 26, in the turbocharger housing 10. Furthermore, the mold slide element 16 has a valve seat section 46 for forming the valve seat 28 in the turbocharger housing 10. The valve seat 28 is formed in this case on the mold slide element 16 in the form of a valve seat projection 48, for example in the form of an encompassing projection. The projection 48 for the valve seat 28 can be formed in this case, moreover, in a manner in which it merges into the outer, first passage section projection 34. The valve seat projection 48 also has no undercut so that the mold slide element 16 can easily be withdrawn from the pressure diecasting mold 14 and from the turbocharger housing 10 in its finished form.

Figure 2:
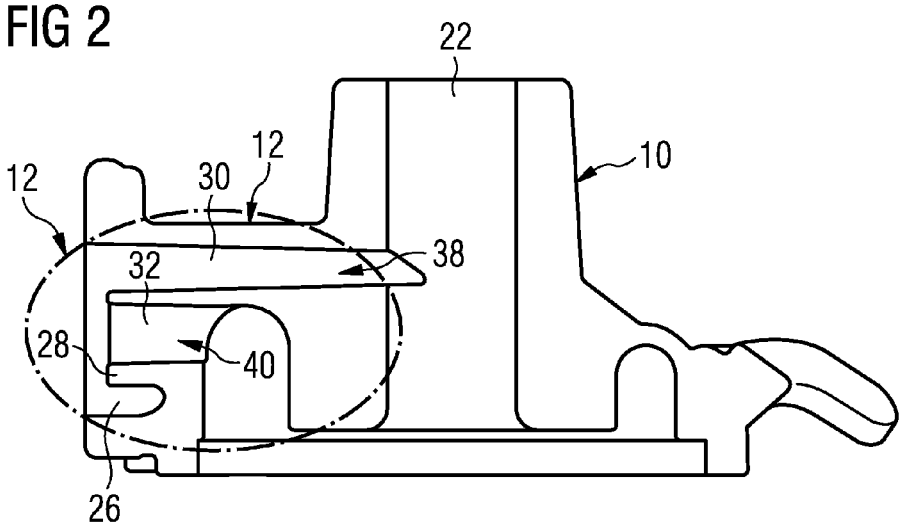
FIG. 2 shows the sectional view of the turbocharger housing according to FIG. 1, without the mold slide element.

Shown in FIG. 2 is the sectional view of the finished turbocharger housing 10 according to FIG. 1, without the mold slide element. As can be gathered from FIG. 2, the compressor housing 10 has an overrun air recirculation valve 12 as the valve device. The two passages 30, 32 of the overrun air recirculation valve 12 are formed parallel to one another in this case. The inlet passage 40 of the overrun air recirculation valve 12 is connected in this case to the pressure side, or here to the spirals 24, of the compressor housing 10 and the outlet passage 38 is connected to the inlet regions of the intake side of the compressor. Furthermore, the overrun air recirculation valve 10 has a valve seat 28 and a valve chamber 26 which are formed completely by means of the mold slide element 16.

Figure 3:
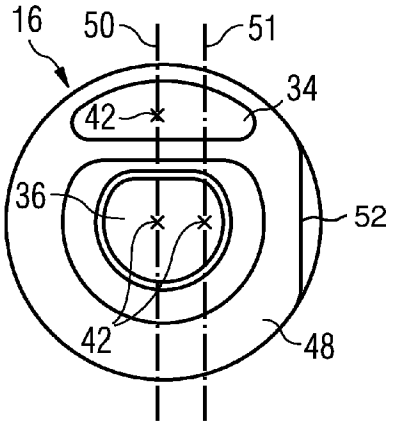
FIG. 3 shows a front view of the mold slide element according to FIG. 1.

FIGS. 3 to 6 show a number of views of the mold slide element 16. As is shown in the front view of the mold slide element 16, the two passage section projections 34, 36 are arranged parallel to one another and not offset in relation to one another, or the longitudinal axes 42 of the two passage section projections 34, 36 both lie in a common vertical plane 50. As is indicated in FIG. 3 by a dash-dot line, the two passage section projections 34, 36, however, can also be arranged parallel and offset in relation to one another. In this case, the longitudinal axes 42 of the two passage section projections 34, 36 are provided in each case in two vertical planes 50, 51 which are offset in relation to each other. The two passage section projections 34, 36 can have any cross-sectional shape, providing the passage section projections 34, 36 do not form, or do not have, undercuts. One of both of the two passage section projections 34, 36 can have for example a constant cross section, for example a cylindrical cross section which is flattened on one side. Similarly, one of or both of the passage section projections 34, 36 can taper in the longitudinal direction or have a tapering cross section in the longitudinal direction, as the first, outer passage section projection 34. In the example shown in FIG. 3, the valve seat projection 48, for example on one side or on both sides, can also be provided with a flat 52, depending on function and intended use.

Figure 4:
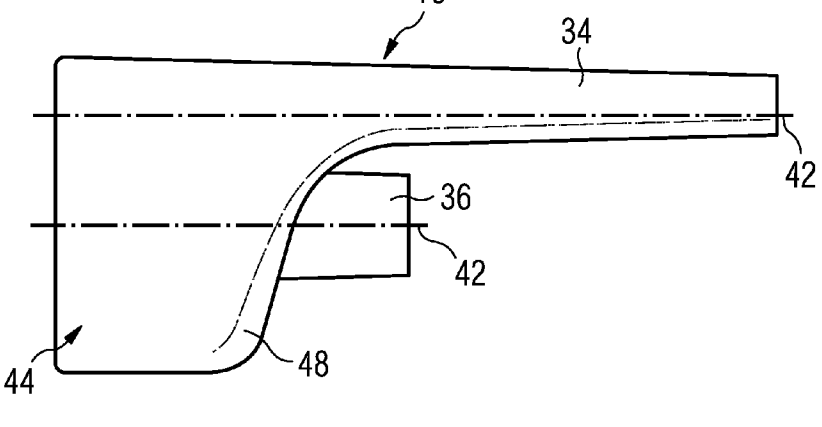
FIG. 4 shows a side view of the mold slide element according to FIGS. 1 and 3.

FIG. 4 shows the mold slide element 16 according to FIG. 3 in a side view. In this case, the transition between the valve seat projection 48 and the first, outer passage section projection 34 is shown.

Figure 5:
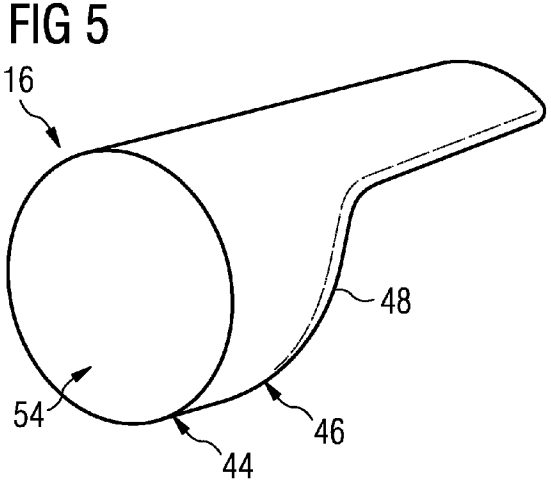
FIG. 5 shows a perspective view of the mold slide element according to FIGS. 1, 3 and 4.

FIG. 5 shows a perspective view of the mold slide element 16 from the rear. In this case, the valve seat projection 48 and the section 44 for forming the valve chamber, and also the outer passage section projection 34, are to be seen. The forming of the end 54 of the mold slide element 16 as a flat surface is greatly simplified and purely by way of example. Depending on how the connection between the pressure diecasting mold and the mold slide element 16, for example, is provided, the mold slide element 16 and its end 54 can be correspondingly designed.

Figure 6:
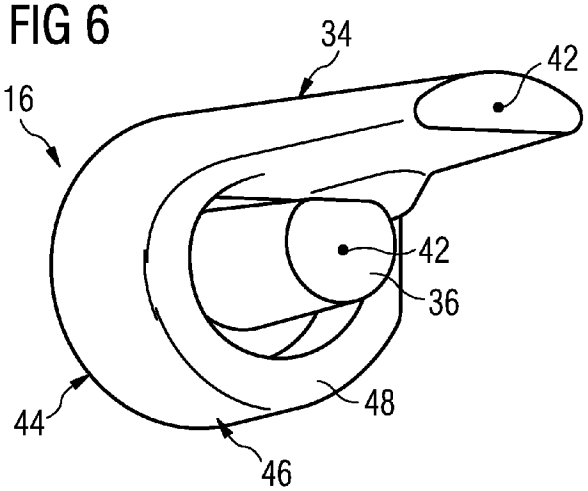
FIG. 6 shows a further perspective view of the mold slide element according to FIGS. 1, 3, 4 and 5.

FIG. 6 shows a perspective view of the mold slide element 16 from the front. Shown in this case are the first 34 and the second passage section projection 36 which are arranged with their longitudinal axes 42 parallel to one another and, moreover, not offset in relation to one another, or without an offset in relation to one another. Also shown is the valve seat projection 48 which merges into the outer passage section projection 34.

Figure 7:
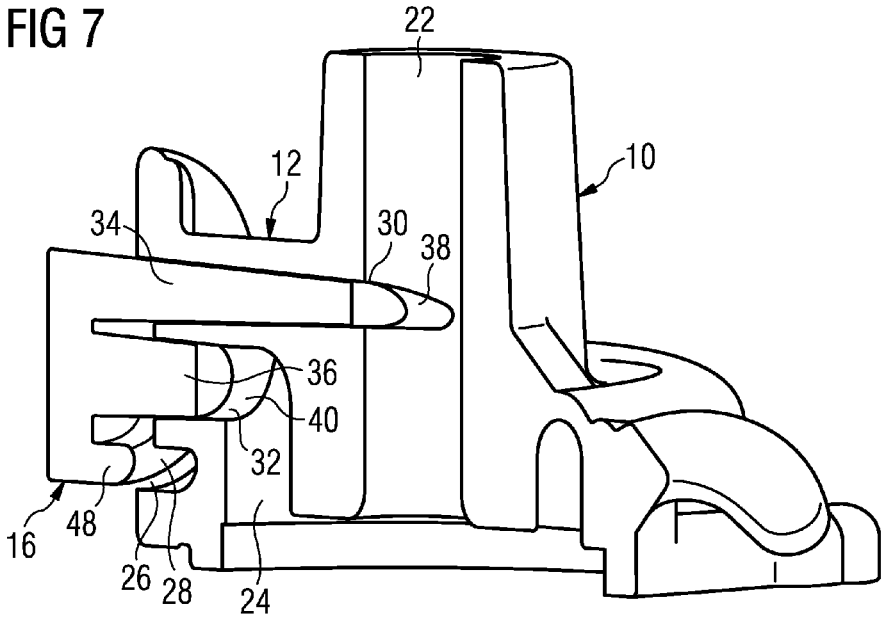
FIG. 7 shows a perspective sectional view of the turbocharger housing, with the valve device, according to FIG. 1, wherein the mold slide element is partially removed from the turbocharger housing.
Figure 8:
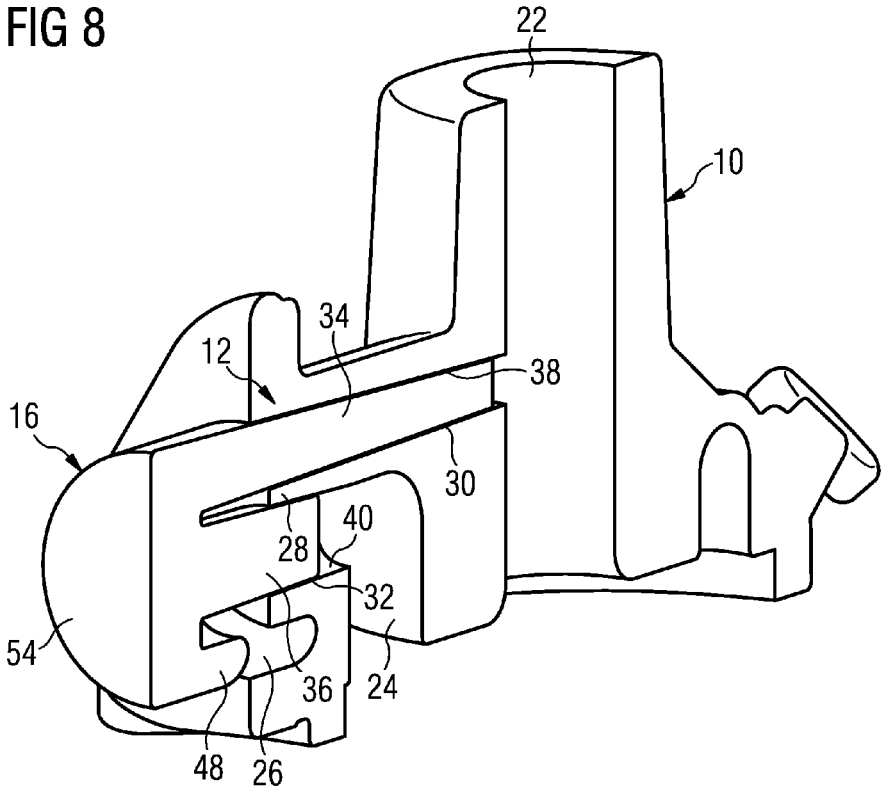
FIG. 8 shows the perspective sectional view of the turbocharger housing, with the valve device, according to FIG. 7, from the point of view of the valve device.

Shown in FIGS. 7 and 8 is a perspective sectional view of the compressor housing 10 according to the invention. Also shown in this case is the mold slide element 16 with which an overrun air recirculation valve 12 is formed in the compressor housing 10. The mold slide element 16 is partially withdrawn from the overrun air recirculation valve 12 in this case. The mold slide element 16 can be formed in this case in such a way that in the fully inserted state the first 34 and the second passage section 36 of the mold slide element 16, as previously indicated in FIG. 1, reaches into the spirals or the spiral housing 24 and the main passage 22 of the compressor housing 10, which are formed for example by one of the two mold halves of the pressure diecasting mold. Similarly, one or both passage section projections 34, 36 of the mold slide element 16 can also terminate with the respective passage 30, 32 of the overrun air recirculation valve 12 of the compressor housing 10 and do not penetrate into the spirals 24 or the main passage 22 of the compressor housing 10 (not shown).

Figure 9:
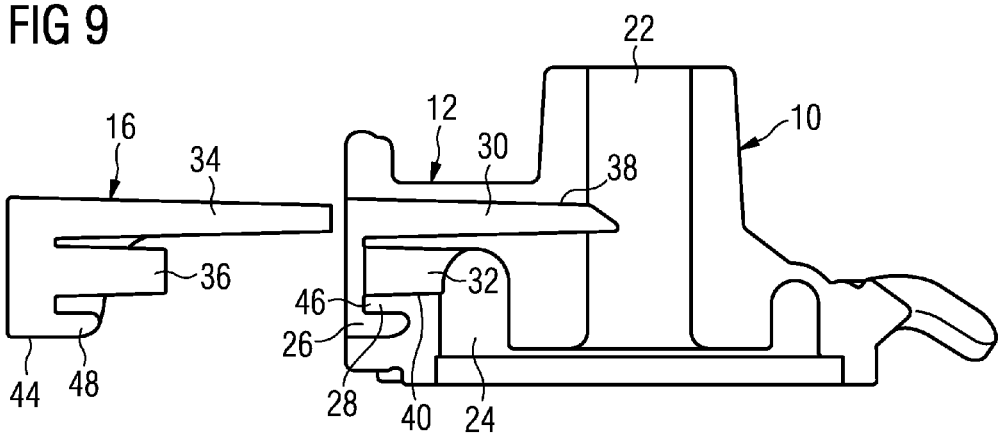
FIG. 9 shows a sectional view of the turbocharger housing and of the mold slide element, wherein the mold slide element is completely removed from the turbocharger housing.

FIG. 9 shows the compressor housing 10 and the mold slide element 16 in a sectional view. Shown in this case is the overrun air recirculation valve 12 with its inlet passage 40 and outlet passage 42, the valve seat 28 and the valve chamber 26. In the inserted state, the mold slide element 16 fits by its contour exactly into the contour of the overrun air recirculation valve 12.

Figure 10:
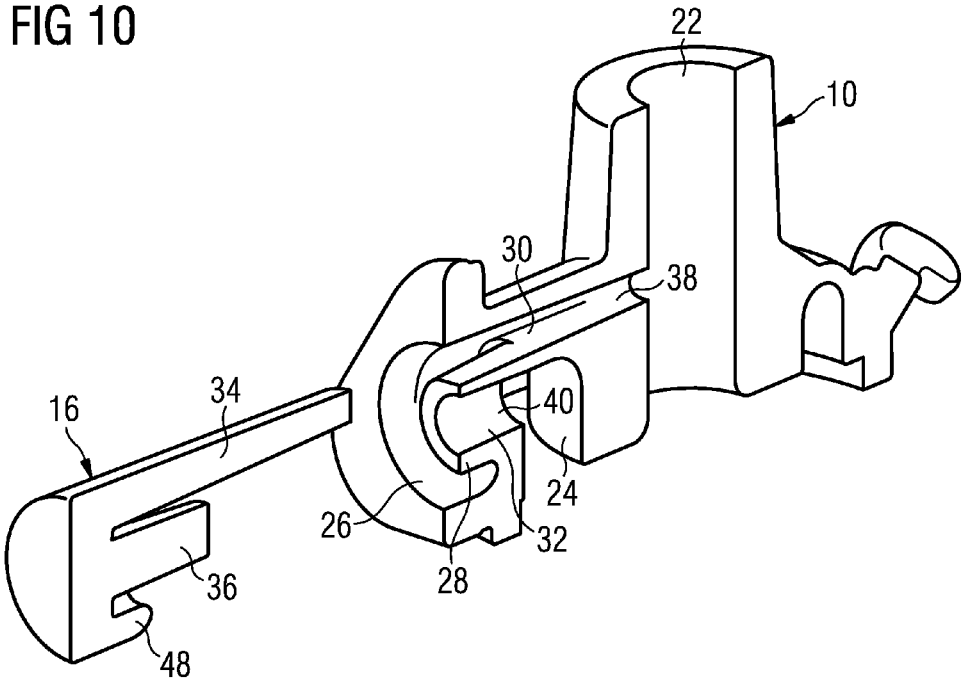
FIG. 10 shows a perspective sectional view of the turbocharger housing and of the mold slide element according to FIG. 1, wherein the mold slide element is completely removed from the turbocharger housing and the turbocharger housing is shown from the point of view of the valve device.

Shown in FIG. 10 in a perspective sectional view are the compressor housing 10 and the mold slide element 16. Shown in this case are the valve chamber 26 and the valve seat 28, and also the inlet passage 40 and the outlet passage 42 of the overrun air recirculation valve 12. The valve seat 28 in this case forms a section of the outlet passage or of the outer passage section 30.

Figure 11:
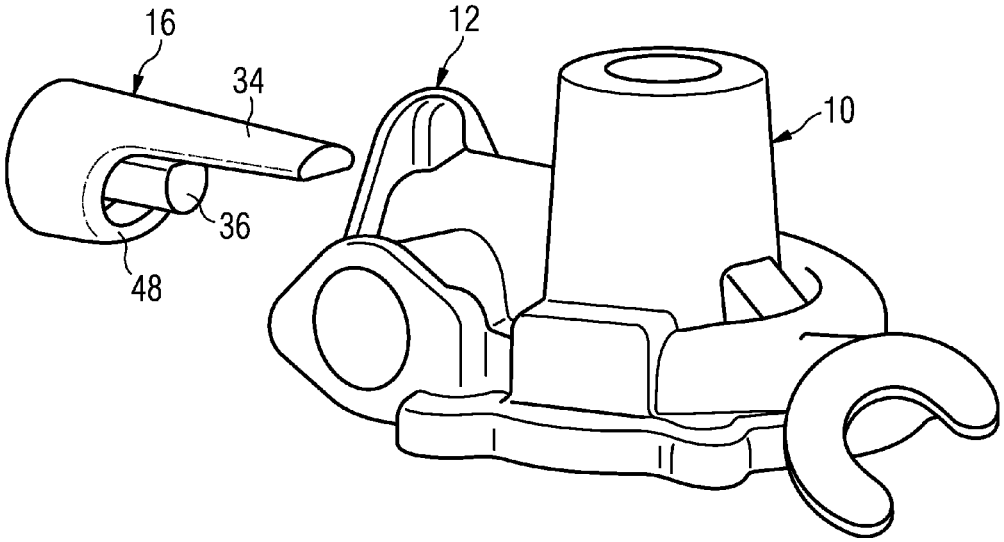
FIG. 11 shows a further perspective view of the turbocharger housing and of the mold slide element according to FIG. 1, wherein the mold slide element is completely removed from the turbocharger housing.

In addition, a perspective view of the compressor housing 10 and of the mold slide element 16 is shown in FIG. 11. As described previously, the turbocharger housing 10, or in this case the compressor housing 10, is produced by pressure diecasting. The mold slide element 16 in this case consists of metal, for example, or another suitable strong or durable material, which preferably allows repeated use of the mold slide element 16.

Figure 12:
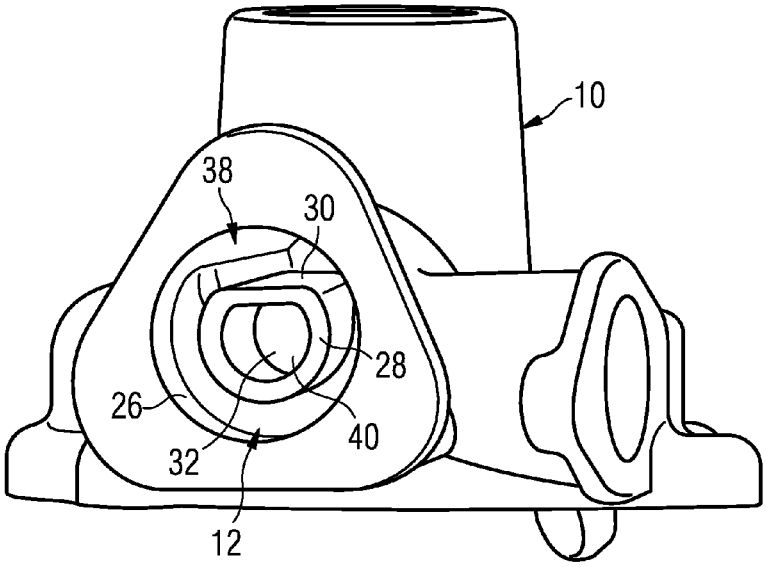
FIG. 12 shows another perspective view of the turbocharger housing from the direction of the valve device.

FIG. 12 shows the compressor housing 10 in a perspective view, wherein the compressor housing 10 is shown from the side of the overrun air recirculation valve 12. Shown in this case are the valve chamber 26 and the valve seat 28 of the overrun air recirculation valve 12, and also its outer outlet passage 38 and the inner inlet passage 40. The outer periphery of the valve seat 26 in this case is of flattened form in the region of the outer passage 28, in this case the outlet passage, in order to form a part of the passage 28. In other words, the section of the valve seat 28 which forms a part of the passage 28 is suitably adapted by its contour to the passage 28 in order to enable an optimum flow through the passage.

The previously described turbocharger housing with a valve device, for example in the form of a compressor housing with an overrun air recirculation valve, has the advantage that the housing and valve can easily be produced in a pressure diecasting process.

In this case, the compressor housing can be produced for example by aluminum pressure diecasting or by another suitable pressure diecasting.

As a result of the parallel axial and, for example, coaxial arrangement of the passages of the overrun air recirculation valve in the mold slide element direction in the pressure diecasting mold, the entire valve chamber, the valve seat and also the overflow passages of the overrun air recirculation valve can be produced in a pressure diecasting mold slide element. This enables either dispensation of any additional mechanical machining or enables only a minimum machining expense which is limited to the sealing and fastening geometry, i.e. to the sealing seat and the fastening holes of the overrun air recirculation valve.

As a result of the arrangement and the position of the mold slide element in the pressure diecasting mold, the number and complexity of the movable parts can be reduced. As a result, production costs can be reduced since the feasibility of a pressure diecastable compressor housing with an overrun air recirculation valve is improved. Furthermore, the complexity of the mold slide element can be reduced and the mold slide element can be simplified. A further advantage in this case is that the machining of the compressor housing or its overrun air recirculation valve can be reduced or even allows geometries which do not require additional mechanical machining, which leads to a further reduction of the production costs.

Although the present invention has been described above based on preferred exemplary embodiments, it is not limited thereto, but can be modified in multifarious ways. The previously described embodiments, especially individual features thereof, can be combined with one another in this case.

The invention claimed is:

1. A turbocharger housing, comprising:

a valve device, said valve device having at least two passages including a first passage and a second passage;

said first and second passages having longitudinal axes extending parallel to one another and said first and second passages being formed without an undercut; and said first passage continuously tapering from one end thereof to an opposite end thereof.

2. The turbocharger housing according to claim 1, wherein said first and second passages, by said longitudinal axes thereof, are arranged in an offset relationship relative to one another or are arranged one above the other in a vertical plane.

3. The turbocharger housing according to claim 1, wherein said second passage has a constant cross section.

4. The turbocharger housing according to claim 1, wherein said second passage tapers towards an end thereof or said second passage has a constant cross section.

5. The turbocharger housing according to claim 1, wherein said valve device is formed with a valve seat and said valve seat forms a segment of one of said first and second passages.

6. The turbocharger housing according to claim 5, wherein said valve seat forms a segment of said first passage and said first passage is an outer passage.

7. The turbocharger housing according to claim 5, wherein said valve seat, in a region thereof that forms said segment, is adapted to a contour of said one of said first and second passages.

8. The turbocharger housing according to claim 7, wherein said segment of said valve seat is formed in a flattened shape corresponding to said one of said first and second passages.

9. The turbocharger housing according to claim 1, wherein said turbocharger housing is a compressor housing, and said compressor housing is formed as a separate compressor housing.

10. The turbocharger housing according to claim 1, wherein said turbocharger housing is a compressor housing, and said compressor housing is formed in one piece with a bearing housing.

11. The turbocharger housing according to claim 1, wherein said valve device is an overrun air recirculation valve, said first passage forms an outlet passage, said first passage is connected to an intake side of a compressor, said second passage forms an inlet passage, and said second passage is connected to a pressure side of the compressor.

12. A method of producing a turbocharger housing with a valve device, the valve device having first and second passages each having a longitudinal axis and the longitudinal axes extend parallel to one another, a first one of said passages of the valve device continuously tapering from one end thereof to an opposite end thereof, the method which comprises:

providing a pressure diecasting mold configured for forming the turbocharger housing;

providing a mold slide element in the pressure diecasting mold configured for forming the valve device in the turbocharger housing, the mold slide element having two passage projections, with a first passage projection forming the first passage and a second passage projection forming the second passage, the two passage projections having longitudinal axes extending parallel to one another, wherein a first one of said passages of said mold slide element continuously tapering from one end thereof to an opposite end thereof; and introducing a pressure diecasting material into the pressure diecasting mold and forming the turbocharger housing with the valve device as a pressure diecasting.

13. The method according to claim 12, wherein the mold slide element is configured for forming a valve seat, a valve chamber, and at least one of the first passage or the second passage of the valve device.

14. The method according to claim 13, wherein the mold slide element is configured for forming an overrun air recirculation valve.

15. The method according to claim 12, wherein the pressure diecasting mold is formed with a first mold half and a second mold half, and the method comprises connecting the mold slide element to at least one mold half or bringing the mold slide element into engagement with the at least one mold half.

16. The method according to claim 12, which comprises withdrawing the mold slide element from the valve device of the turbocharger housing after forming the pressure diecasting.

17. The method according to claim 12, wherein the mold slide element is free of an undercut.

18. The method according to claim 12, which comprises forming the first and second, passages free of any undercuts.

19. The method according to claim 12, wherein a second one of said passages of said mold slide element has a constant cross section.

* * * * *